US009259039B2

(12) United States Patent
Okies et al.

(10) Patent No.: US 9,259,039 B2
(45) Date of Patent: Feb. 16, 2016

(54) FLAT AND THIN ELASTIC WAISTBAND

(71) Applicant: NIKE, Inc., Beaverton, OR (US)

(72) Inventors: Margaret C. Okies, Portland, OR (US); Irina M. Armstrong, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 262 days.

(21) Appl. No.: 13/888,877

(22) Filed: May 7, 2013

(65) Prior Publication Data

US 2014/0331385 A1 Nov. 13, 2014

(51) Int. Cl.
*A41D 1/06* (2006.01)
*A41F 9/02* (2006.01)

(52) U.S. Cl.
CPC ... *A41D 1/06* (2013.01); *A41F 9/02* (2013.01); *A41D 2300/33* (2013.01)

(58) Field of Classification Search
CPC ..... A41F 9/00; A41F 9/025
USPC ..... 2/312, 313
See application file for complete search history.

(56) References Cited

U.S. PATENT DOCUMENTS 1,825,271 A * 9/1931 Karberg ..... 2/237
2,088,302 A * 7/1937 McKeever ..... 602/67
2,349,019 A * 5/1944 Terrell ..... 2/221
2,617,113 A 11/1952 Hardie
3,414,907 A 12/1968 Flame
3,868,729 A * 3/1975 Lynam ..... 2/237
3,887,968 A 6/1975 Lynam
4,372,998 A * 2/1983 Shimada ..... 428/193
RE33,586 E * 5/1991 Graff ..... 2/221
5,186,779 A 2/1993 Tubbs
5,375,266 A * 12/1994 Crisco ..... 2/243.1
5,483,702 A 1/1996 D'Ambrosio
5,963,988 A 10/1999 Jackson, Jr.
6,286,341 B2 * 9/2001 Jackson et al. ..... 66/83

(Continued)

FOREIGN PATENT DOCUMENTS

GB 1404260 A 8/1975
JP 2000178816 A * 6/2000 ..... A41F 9/02

OTHER PUBLICATIONS

JPO Japanese to English Machine translation of Egawa et al. J.P. 2000178816 A translated Mar. 10, 2015.*

(Continued)

*Primary Examiner* — Richale Quinn
*Assistant Examiner* — Anne Kozak
(74) *Attorney, Agent, or Firm* — Shook, Hardy & Bacon L.L.P.

(57) ABSTRACT

A garment includes a waist portion that is elastic and that is configured to be worn at a waist of the wearer. The waist portion includes a diametral surface that extends longitudinally in the circumferential direction. The garment also includes an adhesive tape that is elastic. The adhesive tape is adhesively attached to and layered continuously on the diametral surface of the waist portion. Moreover, the garment includes an elastic band that is adhesively attached to and layered on the adhesive tape to attach the elastic band to the waist portion. The elastic band, the adhesive tape, and the waist portion of the shell are collectively and resiliently stretchable to thereby bias the garment inward in the radial direction to retain the garment on the waist of the wearer.

20 Claims, 3 Drawing Sheets

(56) References Cited

U.S. PATENT DOCUMENTS

| | | | | |
|---|---|---|---|---|
| 7,013,818 | B2 * | 3/2006 | Zhang et al. | 112/475.09 |
| 8,176,571 | B2 * | 5/2012 | Kato | 2/237 |
| 8,555,419 | B2 * | 10/2013 | Demarest et al. | 2/237 |
| 2008/0295302 | A1 * | 12/2008 | Senn | 24/578.1 |
| 2009/0126080 | A1 * | 5/2009 | Kato | 2/237 |
| 2011/0048077 | A1 | 3/2011 | Warren et al. | |

OTHER PUBLICATIONS

"Adhesive,adj." Merriam-Webster.com. Mar. 2015. Web. Mar. 23, 2015. http://www.merriam-webster.com/dictionary/adhesive.*

"Monolithic, adj." Merriam-Webster.com. Mar. 2015. Web. Mar. 23, 2015. http://www.merriam-webster.com/dictionary/monolithic.*

International Search Report and Written Opinion for Application No. PCT/US2014/035834, mailed on Oct. 6, 2014, 11 pages.

* cited by examiner

FLAT AND THIN ELASTIC WAISTBAND

FIELD

The present disclosure relates to a waistband and, more particularly, relates to a waistband that is substantially flat and that is relatively thin.

BACKGROUND

This section provides background information related to the present disclosure which is not necessarily prior art.

Various types of elastic waistbands have been proposed for retaining pants, shorts, and other garments on the waist of the wearer. Specifically, the waistband can be an annular member that is attached to the garment and that is resiliently elastic. The waistband can be slightly smaller in diameter than the wearer's waist such that, when the waistband is worn, the waist can resiliently expand the waistband in a radially outward direction. The waistband can, thus, bias radially inward to hold the garment to the wearer's waist.

SUMMARY

This section provides a general summary of the disclosure, and is not a comprehensive disclosure of its full scope or all of its features.

A garment is disclosed that includes a shell configured to cover a bodily area of a wearer. The shell includes a waist portion that is elastic and that is configured to be worn at a waist of the wearer. The waist portion defines a circumferential direction, a radial direction, and a transverse direction that is transverse to the circumferential and radial directions. The waist portion includes a diametral surface that extends longitudinally in the circumferential direction. The garment also includes an adhesive tape that is elastic. The adhesive tape is adhesively attached to and layered continuously on the diametral surface of the waist portion. Moreover, the garment includes an elastic band that is adhesively attached to and layered on the adhesive tape to attach the elastic band to the waist portion. The elastic band, the adhesive tape, and the waist portion of the shell are collectively and resiliently stretchable to thereby bias the garment inward in the radial direction to retain the garment on the waist of the wearer.

Also, a garment is disclosed that includes a shell configured to cover a bodily area of a wearer. The shell includes an annular waist portion that is elastic and that is configured to be worn about a waist of the wearer. The waist portion defines a circumferential direction, a radial direction, and a transverse direction that is transverse to both the circumferential and radial directions. The waist portion is folded over itself to define a cross section with a first radial layer, a second radial layer, an upper rim, and a pocket between the first radial layer, the second radial layer, and the upper rim. The second radial layer defines a terminal edge of the shell that is spaced from the upper rim. The garment also includes an elastic band with a first radial surface, a second radial surface, an upper edge, and a lower edge. The elastic band is received in the pocket such that the terminal edge is disposed between the upper and lower edges in the transverse direction. The first radial surface is attached to the first radial layer. The waist portion and the elastic band are collectively and resiliently stretchable to thereby bias the garment inward in the radial direction to retain the garment on the waist of the wearer.

Moreover, a pair of shorts is disclosed that includes an elastic shell configured to at least partially cover a waist, groin, and buttock area of a wearer. The shell includes an integrally attached annular waist portion that is elastic and that is configured to be worn about the waist of the wearer. The waist portion defines a circumferential direction, a radial direction, and a transverse direction that is transverse to both the circumferential and radial directions. The waist portion is folded over itself inwardly in the radial direction to define a cross section with a first radial layer, a second radial layer, an upper rim, and a pocket between the first radial layer, the second radial layer, and the upper rim. The second radial layer defines a terminal edge of the shell. Additionally, the pair of shorts includes an adhesive tape that is elastic. The adhesive tape has a first longitudinal end and a second longitudinal end. The adhesive tape is folded over on itself and received within the pocket to layer over and adhesively attach to the first radial layer, the second radial layer, and the upper rim substantially continuously in the circumferential direction from the first longitudinal end to the second longitudinal end. The pair of shorts additionally includes an elastic band that is adhesively attached to and layered on the adhesive tape to attach the elastic band to the waist portion. The elastic band includes a first radial surface, a second radial surface, an upper edge, and a lower edge. The elastic band is received in the pocket such that the terminal edge is disposed between the upper and lower edges in the transverse direction. The first radial surface is adhesively attached to the first radial layer via the adhesive tape. The second radial surface is adhesively attached to the second radial layer via the adhesive tape. The waist portion, the adhesive tape, and the elastic band are collectively and resiliently stretchable to thereby bias the garment inward in the radial direction to retain the garment on the waist of the wearer. The elastic band includes a first elastic strip and a second elastic strip. The first and second elastic strips each extend substantially in the circumferential direction. The first and second elastic strips are joined by a plurality of connecting members that extend generally in the transverse direction. A tunnel is collectively defined by the first and second elastic strips and the plurality of connecting members. Also, the pair of shorts includes a resiliently elastic drawstring that is received within the tunnel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
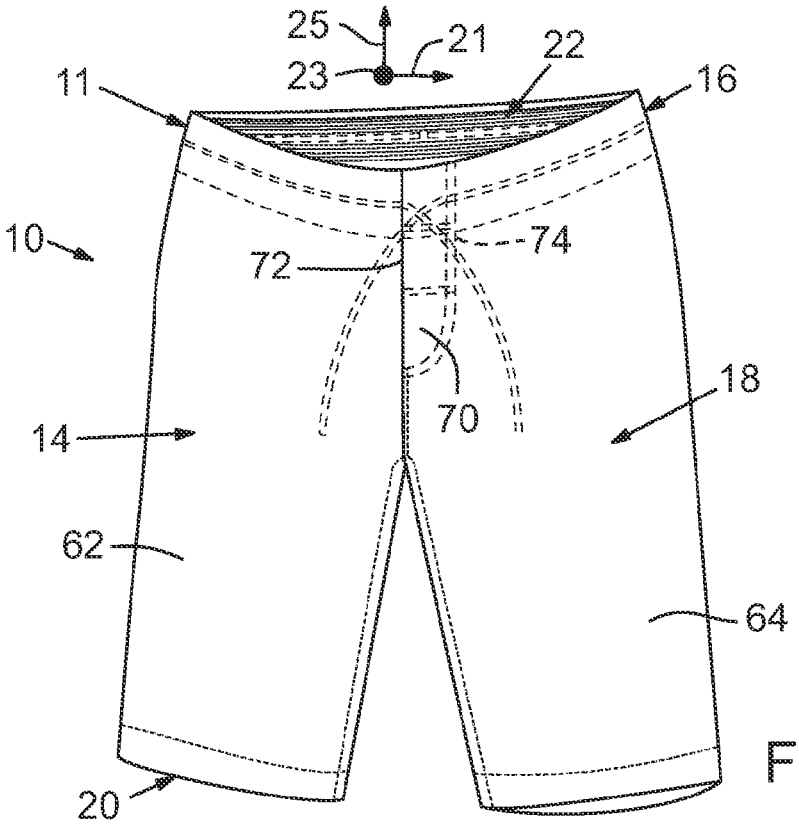
FIG. 1 is a front view of a garment with a waistband according to exemplary embodiments of the present disclosure.
Figure 2:
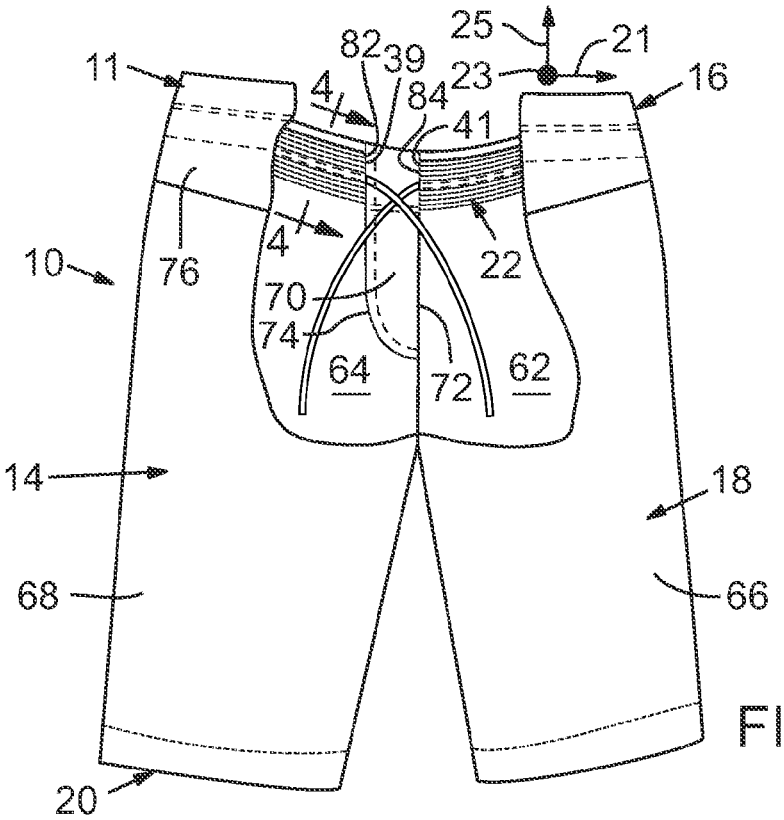
FIG. 2 is a rear view of the garment of FIG. 1 with a posterior portion removed.
Figure 3:
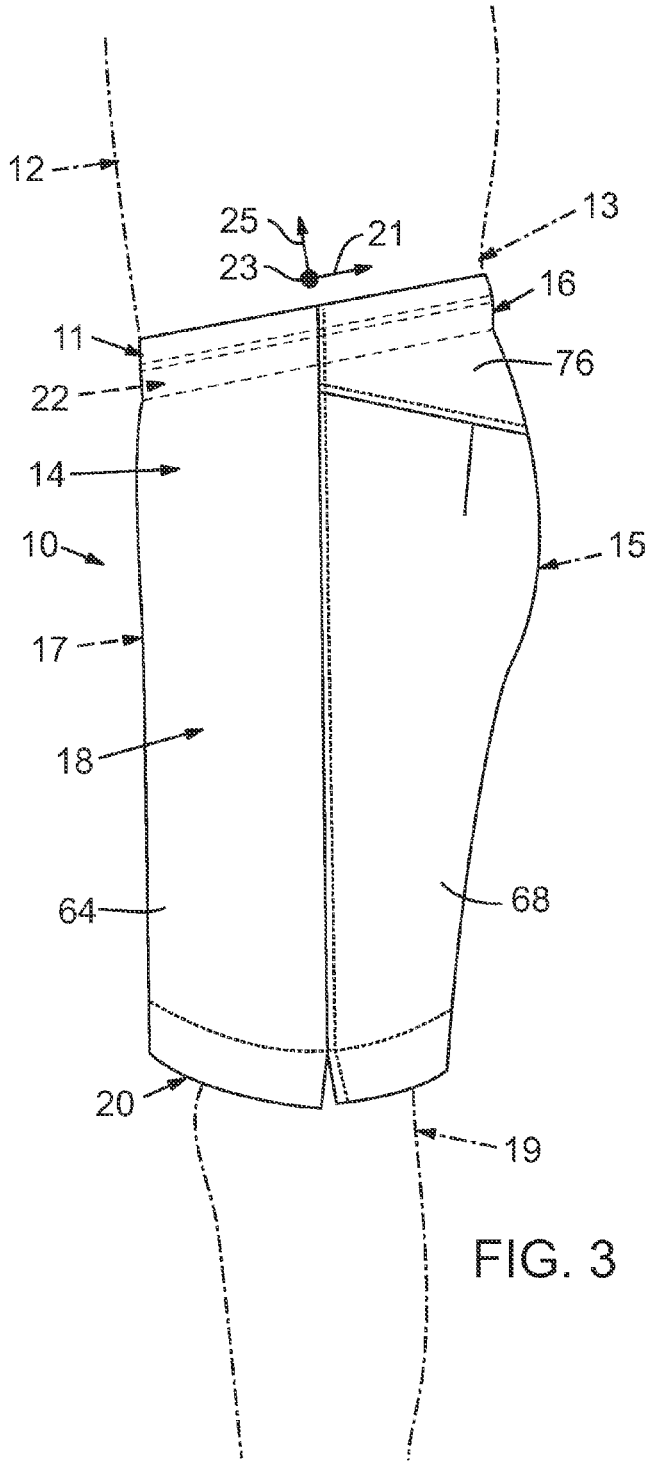
FIG. 3 is a side view of the garment of FIG. 1 with a wearer shown in phantom.

Referring initially to FIGS. 1-3, a garment 10 is illustrated according to exemplary embodiments of the present disclosure. The garment 10 can be worn by a wearer 12 (shown in phantom in FIG. 3). In the embodiments illustrated, the garment 10 is a pair of shorts that is configured to be worn and at least partially cover the waist 13, the buttocks 15, the groin 17, and the upper legs 19 (i.e., thighs) of the wearer 12. However, it will be appreciated that the garment 10 could be a pair of pants, a skirt, or any other type without departing from the scope of the present disclosure.

The garment 10 can generally include a hollow, generally tubular main body 18 with an annular waistband assembly 11. The waistband assembly 11 can be resiliently elastic. The main body 18 can also branch apart and terminate at separate cuffs 20. The cuffs 20 and waistband assembly 11 are disposed on opposite ends of the main body 18.

As shown in FIG. 3, when the garment 10 is worn, the waist band assembly 11 can extend annularly and continuously about the waist 13 of the wearer 12, the cuffs 20 can extend annularly and continuously about respective legs 19 (e.g., about the thighs, knees, etc.) of the wearer 12, and the main body 18 can extend over and cover the buttocks 15 and groin 17 of the wearer 12.

In embodiments in which the garment 10 is a pair of pants, the cuffs 20 can extend about respective ankles or shins of the wearer 12. Furthermore, the garment 10 can be a skirt, wherein there is a single cuff 20 that extends annularly and continuously about both legs 19 of the wearer 12. It will also be appreciated that the garment 10 could be configured differently without departing from the scope of the present disclosure.

Since the waistband assembly 11 is annular, the waistband assembly 11 can define a circumferential direction 21, a radial direction 23, and a transverse direction 25. See FIGS. 1-4. The waistband assembly 11 can extend continuously about the waist 13 of the wearer 12 in the circumferential direction 21. The radial direction 23 can extend between the waistband assembly 11 and the longitudinal axis of the wearer 12. The transverse direction 25 can be transverse to both the circumferential and radial directions 21, 23 (e.g., can extend in the superior/inferior direction relative to the wearer 12).

The width (i.e., diameter) of the waistband assembly 11 can be slightly smaller than the diameter of the waist 13 of the wearer 12. As such, the waist 13 of the wearer 12 can push the waistband assembly 11 outward in the radial direction 23, thereby resiliently stretching the waistband assembly 11 outwardly in the radial direction 23 (away from the neutral position shown in FIG. 1). As a result, the waistband assembly 11 can bias the garment 10 radially inward against the waist 13 of the wearer 12 to retain the garment 10 on the waist 13 of the wearer 12.

Also, as will be discussed in detail, the waistband assembly 11 can have a relatively small thickness (measured in the radial direction 23 from the inner diameter surface to the outer diameter surface). As such, the garment 10 can extend only slightly off the waist 13 of the wearer 12 in the radial direction 23. Thus, the garment 10 can appear more streamlined with the body of the wearer 12, and the garment 10 can feel less bulky. Moreover, the waistband assembly 11 is unlikely to bunch up as will be discussed in detail below. As such, the garment 10 can lie substantially flat against the waist 13 of the wearer 12 so that pressure from the garment 10 is more likely to be evenly distributed on the waist 13 of the wearer 12, and the garment 10 can be more comfortable to wear. The garment 10 can also be more aesthetically pleasing than conventional waistbands that bunch up.

Referring now to FIGS. 1-4, components of garment 10 will be discussed in greater detail. In some embodiments, for instance, the garment 10 can include a shell 14 (e.g., an outer shell 14) that defines the majority of the garment 10. The shell 14 can be constructed from a plurality of flat panels 62, 64, 66, 68, 70, 76 of material that are joined together via stitching, adhesives, or in another manner. In the embodiments illustrated, for instance, the shell 14 can include a first front panel 62 and second front panel 64, which are joined to cover the groin 17 and the anterior portions of the legs 19. The shell 14 can also include a first back panel 66 and a second back panel 68, which are joined together to cover the buttocks 15 and posterior of the legs 19 of the wearer 12. The shell 14 can further include at least one fly panel 70 that is attached at a first edge 72 to the first front panel 62 and that is attached at a second edge 74 to the second front panel 64. Moreover, the shell 14 can include a rear upper panel 76 (FIGS. 2 and 3) that is layered over both the first and second back panels 66, 68 and over a posterior portion of the waistband assembly 11. In the embodiments shown, the panels 62, 64, 66, 68, 70, 76 can collectively define most portions of the main body 18 of the garment 10, and the front panels 62, 64 and back panels 66, 68 can define the cuffs 20 of the garment 10.

The material of the panels 62, 64, 66, 68, 70, 76 can be of any suitable type, such as a flexible and resiliently elastic knit or woven fabric. Also, the material can be 4-way resiliently stretchable material (i.e., stretchable in both the circumferential and transverse directions 21, 25 and, thus stretchable in the radial direction 23). Moreover, in some embodiments, the material of the panels 62, 64, 66, 68, 70, 76 can be 2-way stretchable material (i.e., stretchable in the circumferential direction 21. Additionally, in some embodiments, the fabric can include a combination of polyester and spandex fibers that are knit or woven together in a known manner.

The shell 14 can include a waist portion 16, which can be the outermost layer (in the radial direction 23) of the waist assembly 11. In the embodiments illustrated, for instance, the upper parts of the panels 62, 64, 70, 76 of the shell 14 collectively define the waist portion 16. Also, the lower parts of the panels 62, 64, 70, 76 (i.e., the "adjacent portions") extend downward and away from the waist portion 16 of the garment 10. In some embodiments, the upper parts of the panels 62, 64, 70, 76 are integrally connected to the adjacent lower parts of the panels 62, 64, 70, 76 such that the panels 62, 64, 70, 76 are each monolithic (i.e., a single piece of material). However, the waist portion 16 could be separate from the shell 14 in additional embodiments.

Moreover, the waist portion 16 can be elastic and resiliently stretchable in the circumferential direction 21, and this stretching can cause the waist portion 16 to resiliently bias inward in the radial direction 23 when the garment 10 is worn.

Figure 4:
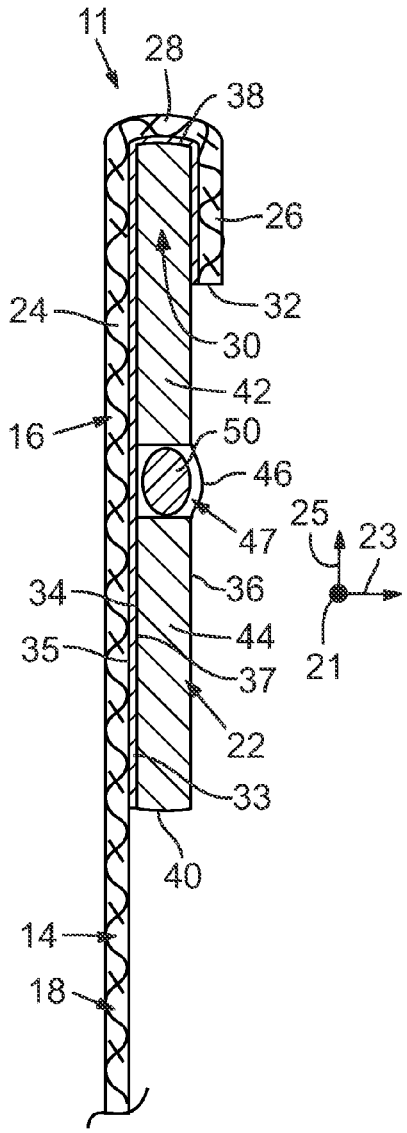
FIG. 4 is a cross section of the waistband taken along the line 4-4 of FIG. 2.

As shown in FIG. 4, the waist portion 16 can extend upward in the transverse direction 25 from the main body 18 and can be folded over on itself. The waist portion 16 can be folded inwardly in the radial direction 23 as shown in FIG. 4, or in additional embodiments, the waist portion 16 can be folded outwardly in the radial direction 23. Thus, as shown in the cross section of FIG. 4, the waist portion 16 can define a first radial layer 24, a second radial layer 26, and an upper rim 28. The second radial layer 26 can terminate at a terminal edge 32 that is spaced away from the upper rim 28 in the transverse direction 25. Also, the folded waist portion 16 can define a pocket 30 between the first radial layer 24, the second radial layer 26, and the upper rim 28.

Figure 5:
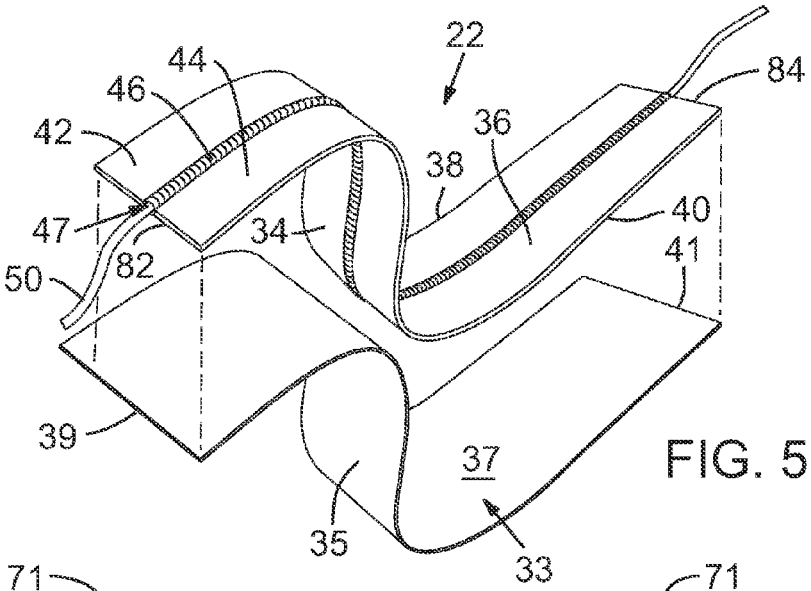
FIG. 5 is a perspective view of an elastic band, a drawstring, and an adhesive tape of the garment of FIG. 1.

The garment 10 can further include an elastic band 22, which is shown independently in FIG. 5. It will be appreciated that the elastic band 22 can be of any suitable type, such as a band that is made from and/or includes elastic material, such as rubber, spandex fibers, etc. The elastic band 22 can also be made from knit or woven elastic threads in some embodiments.

In the embodiments shown in FIG. 5, the band 22 includes a first elastic strip 42 and a second elastic strip 44 that are both relatively long and thin and that are relatively flat. The strips 42, 44 can be arranged substantially parallel to each other and spaced from each other, and the strips 42, 44 can be joined by a plurality of connecting members 46. In some embodiments, the connecting members 46 can be flexible threads or strings that are connected attached to (e.g., knit or woven to) the strips 42, 44. The connecting members 46 can extend transversely relative to (e.g., perpendicular to) the strips 42, 44.

As shown in FIGS. 4 and 5, the first strip 42 can define an upper edge 38 of the band 22, and the second strip 44 can define a lower edge 40 of the band 22. Also, the first and second strips 42, 44 can collectively define a first radial surface 34 and a second radial surface 36, which are opposite each other. Moreover, the first and second strips 42, 44 can collectively define a first end 82 of the band 22 and a second end 84 of the band 22 as shown in FIG. 5.

Moreover, a tunnel 47 (FIG. 5) can be defined between the first strip 42, the second strip 44 and between the connecting members 46. In some embodiments, a drawstring 50 can be received within the tunnel 47 and can protrude out partially from both ends of the tunnel 47. The drawstring 50 can be flexible, and in some embodiments, the drawstring 50 can be resiliently elastic. It will be appreciated that the drawstring 50 could be otherwise attached to the elastic band 22 or to other portions of the garment 10. Also, it will be appreciated that the garment 10 could be configured without a drawstring 50 and that the elasticity of other portions of the waistband assembly 11 could be sufficient for retaining the waistband assembly 11 at the waist 13 of the wearer 12.

The elastic band 22 can be at least partially received within the pocket 30 as shown in FIG. 4. Also, the elastic band 22 can be attached to the waist portion 16 in any suitable fashion (e.g., adhesively attached, attached via stitching, etc.). For instance, the elastic band 22 can be attached to the waist portion 16 via an adhesive tape 33 (FIG. 5), which will be discussed in detail below.

Moreover, the elastic band 22 can extend completely and continuously about the waist portion 16 in the circumferential direction 21 in some embodiments. In additional embodiments shown in FIG. 2, the elastic band 22 can be interrupted only by the fly panel 70. Thus, the first end 82 of the band 22 can be disposed immediately adjacent the first edge 72 of the fly panel 70, and the second end 84 of the band 22 can be disposed immediately adjacent the second edge 74 of the fly panel 70.

As stated, the elastic band 22 can be attached to the waist portion 16 via the adhesive tape 33. As shown in FIG. 5, the adhesive tape 33 can be relatively long, thin, and flat so as to include a first surface 35 and a second surface 37 that are opposite each other. The adhesive tape 33 can also define a first longitudinal end 39 and a second longitudinal end 41 that are opposite each other. Also, the adhesive tape 33 can be resiliently elastic and flexible. The adhesive tape 33 can also be made out of a thermoplastic material. In some embodiments, the adhesive tape 33 can be a high-modulus adhesive tape or elasticized adhesive tape. Moreover, in some embodiments, the adhesive tape 33 can be of a type that is commercially available from Bemis Associates, Inc. of Shirley, Mass.

Moreover, in some embodiments, the adhesive tape 33 can be a single strip that extends continuously and annularly about the waist assembly 11 in the circumferential direction 21. In additional embodiments, the adhesive tape 33 can include a plurality of strips that are aligned end-to-end so as to collectively define a continuous adhesive layer that extends continuously and annularly about the waist assembly 11 in the circumferential direction 21. In still more embodiments, the adhesive tape 33 can include one or more strips that extend about the waist assembly 11 with at least one gap. For instance, the adhesive tape 33 can extend about the waist assembly 11 in the circumferential direction 21, and the adhesive tape 33 can be interrupted only by the fly panel 70. Thus, the first longitudinal end 39 of the adhesive tape 33 can be disposed immediately adjacent the edge 72 of the fly panel 70, and the second longitudinal end 41 of the tape 33 can be disposed immediately adjacent the edge 74 of the fly panel 70. It will be appreciated, however, that the adhesive tape 33 can be adhesively attached continuously along the waist assembly 11 from the first longitudinal end 39 to the second longitudinal end 41 (i.e., the entire surface 35 can be layered on and adhesively attached to the waist portion 16 and/or the entire surface 37 can be layered on and adhesively attached to the elastic band 22).

Figure 6:
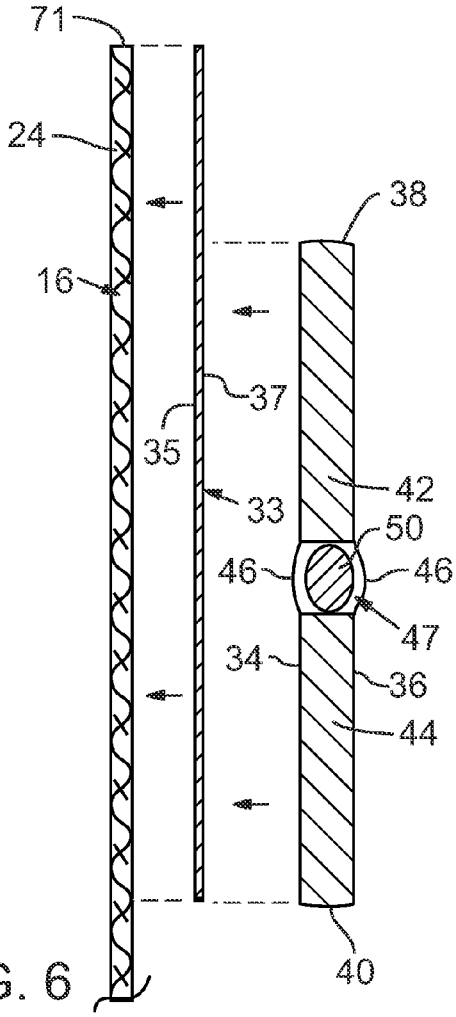
FIG. 6 is a cross section of a shell and elastic tape of the garment shown in the process of being attached according to exemplary embodiments of the present disclosure.
Figure 7:
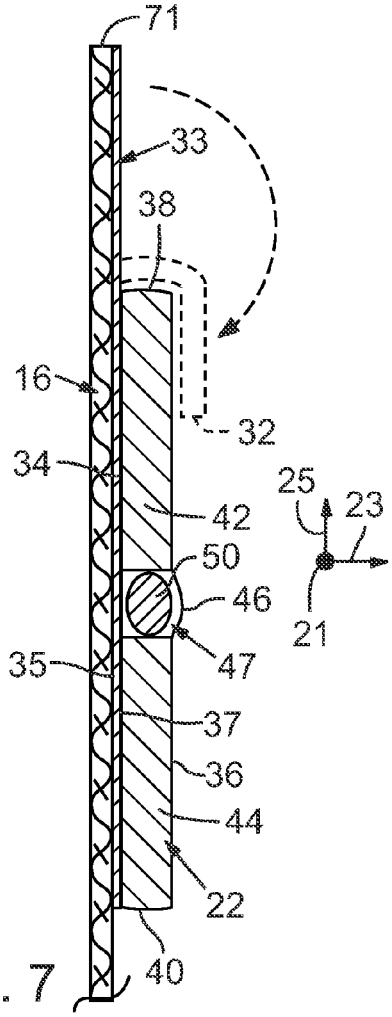
FIG. 7 is a cross section of the shell, elastic tape, and elastic band of the garment shown in the process of being attached according to exemplary embodiments of the present disclosure.

FIGS. 6 and 7 illustrate exemplary ways to attach the elastic band 22 and adhesive tape 33 to the waist portion 16. As shown in FIG. 6, the first surface 35 of the adhesive tape 33 can be layered on one surface (e.g., the inner diameter surface) of the waist portion 16 (FIG. 6), and the first radial surface 34 of the elastic band 22 can be layered on the second surface 37 of the adhesive tape 33. Both the first and second strips 42, 44 can be layered on the second surface 37 of the tape 33. Also, as shown in FIG. 6, the adhesive tape 33 can be substantially aligned with a terminal end 71 of the waist portion 16, and the elastic band 22 can be spaced downwardly from the terminal end 71 when layered on the tape 33.

Subsequently, the terminal end 71 of the waist portion 16 (and the corresponding portion of the adhesive tape 33) can be folded over the upper edge 38 of the elastic band 22 as represented by a curved, broken arrow in FIG. 7. Heat and pressure can then be applied such that surface 35 of the adhesive tape 33 adhesively attaches to the waist portion 16, and the surface 37 of the adhesive tape 33 adhesively attaches to the first radial surface 34 (i.e., both the first and second strips 42, 44), the upper rim 38, and the second radial surface 36 of the elastic band 22. As a result, the terminal edge 32 of the waist portion 16 can be disposed between the upper and lower edges 38, 40 of the band 22 in the transverse direction 25.

It will be appreciated that the elastic band 22, adhesive tape 33, and waist portion 16 can be joined using any suitable amount of pressure, heat, and for any suitable duration. For instance, the elastic band 22, the adhesive tape 33, and the waist portion 16 can be joined by pressing between 40 psi to 60 psi for 20 to 30 seconds while heat is applied between 150° F. and 170° F.

The waist portion 16, adhesive tape 33, and elastic band 22 can have complimentary (e.g., substantially similar) elasticity characteristics (e.g., resiliency, stiffness, resistance to resilient stretching, etc.). Thus, one of these components is unlikely to stretch and/or resiliently recover more than another. As such, the waistband assembly 11 can stretch and recover as a unit, and localized bunching of the waistband assembly 11 is unlikely. Also, the overall thickness of the waistband assembly 11 is relatively small.

As a result, the waistband assembly 11 can be more comfortable since pressure is more likely to be evenly distributed on the waist 13 of the wearer 12. Also, the waistband assembly 11 can fit closer to the waist 13 for a more streamlined and aesthetically pleasing look.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A garment configured to cover a bodily area of a wearer, the garment comprising:

a waist portion that is elastic, the waist portion being configured to be worn at a waist of the wearer, the waist portion defining a circumferential direction, a radial direction, and a transverse direction that is transverse to the circumferential and radial directions, the waist portion including a diametral surface that extends longitudinally in the circumferential direction;

an adhesive tape that is elastic, the adhesive tape being adhesively attached to and layered continuously on the diametral surface of the waist portion; and an elastic band that is adhesively attached to and layered on the adhesive tape to attach the elastic band to the waist portion, the elastic band including a first radial surface, a second radial surface that opposes the first radial surface, an upper edge, and a lower edge, wherein the waist portion includes a cross section with a first radial layer, an upper rim, and a second radial layer, the second radial layer defining a terminal end of the waist portion, wherein a pocket is defined between the first radial layer, the second radial layer, and the upper rim of the waist portion, wherein the adhesive tape and the elastic band are received within the pocket with the first radial surface of the elastic band facing the first radial layer of the waist portion, the second radial surface of the elastic band facing the second radial layer, and the upper edge being proximate the upper rim, and wherein the waist portion, in the cross section, is layered over the first radial surface of the elastic band, the upper edge, and the second radial surface of the elastic band with the terminal edge disposed between the upper edge and the lower edge of the elastic band in the transverse direction such that at least a portion of the second radial surface of the elastic band remains uncovered from the waist portion.

2. The garment of claim 1, wherein the elastic band includes a first elastic strip and a second elastic strip, the first and second elastic strips each extending in the circumferential direction, the first and second elastic strips being joined by at least one connecting member that extends generally in the transverse direction, at least one of the first and second elastic strips being adhesively attached to the waist portion via the adhesive tape.

3. The garment of claim 2, wherein the at least one connecting member includes a plurality of connecting members, wherein a tunnel is defined in the transverse direction between the first and second elastic strips and in the radial direction between respective ones of the plurality of connecting members, and further comprising a drawstring that is received within the tunnel.

4. The garment of claim 3, wherein the drawstring is resiliently elastic.

5. The garment of claim 1, further comprising an adjacent portion that is configured to cover a body part of the wearer that is adjacent the waist, wherein the adjacent portion and the waist portion are both elastic, and wherein at least part of the waist portion extends continuously to the adjacent portion such that the at least part of the waist portion and the adjacent portion define a single piece of material.

6. The garment of claim 5, wherein the garment is a pair of shorts, and wherein the adjacent portion is configured to cover at least one of a buttocks area, a groin area, and an upper leg area of the wearer.

7. The garment of claim 1, wherein the adhesive tape is layered on the first radial layer and the second radial layer of the waist portion.

8. The garment of claim 7, wherein the adhesive tape is layered on the first radial layer, the upper rim, and the second radial layer.

9. The garment of claim 1, wherein the adhesive tape has a first longitudinal end and a second longitudinal end, and wherein the adhesive tape is layered on and adhesively attached to the diametral surface continuously in the circumferential direction from the first longitudinal end to the second longitudinal end.

10. A garment comprising:

an annular waist portion that is elastic and that is configured to be worn about a waist of the wearer, the waist portion defining a circumferential direction, a radial direction, and a transverse direction that is transverse to both the circumferential and radial directions, the waist portion being folded over itself to define a cross section with a first radial layer, a second radial layer, an upper rim, and a pocket between the first radial layer, the second radial layer, and the upper rim, the second radial layer defining a terminal edge of the waist portion, the terminal edge being spaced at a distance from the upper rim; and an elastic band with a first radial surface, a second radial surface, an upper edge, and a lower edge, the elastic band being received in the pocket such that the second radial layer is layered on the second radial surface with the terminal edge disposed between the upper and lower edges in the transverse direction such that at least a portion of the second radial surface of the elastic band remains uncovered from the waist portion, the waist portion and the elastic band collectively and resiliently stretchable to thereby bias the garment inward in the radial direction to retain the garment on the waist of the wearer.

11. The garment of claim 10, further comprising an adhesive tape that is elastic, the adhesive tape adhesively attaching the first radial surface to the first radial layer.

12. The garment of claim 11, wherein the adhesive tape has a first longitudinal end and a second longitudinal end, and wherein the adhesive tape is layered on and adhesively attached to the first radial layer continuously in the circumferential direction from the first longitudinal end to the second longitudinal end.

13. The garment of claim 10, wherein the second radial surface is attached to the second radial layer.

14. The garment of claim 13, further comprising an adhesive tape that is elastic, the adhesive tape being folded over on itself such that the adhesive tape adhesively attaches the first radial surface to the first radial layer and the second radial surface to the second radial layer.

15. The garment of claim 10, wherein at least one of the waist portion and the elastic band defines a tunnel that extends in the circumferential direction, and further comprising a drawstring that is received within the tunnel.

16. The garment of claim 15, wherein the elastic band includes a first elastic strip and a second elastic strip, the first and second elastic strips each extending in the circumferential direction, the first and second elastic strips being joined by a plurality of connecting members that extend in the transverse direction, the tunnel defined in the transverse direction between the first and second elastic strips and in the radial direction between respective ones of the plurality of connecting members.

17. The garment of claim 15, wherein the drawstring is resiliently elastic.

18. The garment of claim 10, further comprising an adjacent portion that is configured to cover a body part of the wearer that is adjacent the waist, wherein the adjacent portion and the waist portion are both elastic, and wherein at least part of the waist portion extends continuously to the adjacent portion such that the at least part of the waist portion and the adjacent portion define a single piece of material.

19. The garment of claim 10, wherein the garment is a pair of shorts.

20. A pair of shorts comprising:

a body configured to cover at least one of a leg, groin, and buttock area of a wearer; and a waistband assembly that is attached to the body and that includes:

a waist portion that is elastic and configured to be worn about the waist of the wearer, the waist portion defining a circumferential direction, a radial direction, and a transverse direction that is transverse to both the circumferential and radial directions, at least part of the waist portion extending continuously to the body such that the part of the waist portion and the body define a single piece of material, the waist portion being folded over itself inwardly in the radial direction to define a cross section with a first radial layer, a second radial layer, an upper rim, and a pocket between the first radial layer, the second radial layer, and the upper rim, the second radial layer defining a terminal edge of the shell;

an adhesive tape that is elastic, the adhesive tape having a first longitudinal end and a second longitudinal end, the adhesive tape being folded over on itself and received within the pocket to layer over and adhesively attach to the first radial layer, the second radial layer, and the upper rim continuously in the circumferential direction from the first longitudinal end to the second longitudinal end; and an elastic band that is adhesively attached to and layered on the adhesive tape to attach the elastic band to the waist portion, the elastic band including a first radial surface, a second radial surface that opposes the first radial surface, an upper edge, and a lower edge, the elastic band being received in the pocket such that the terminal edge is disposed between the upper and lower edges in the transverse direction, the first radial surface being adhesively attached to the first radial layer via the adhesive tape, the second radial surface being adhesively attached to the second radial layer via the adhesive tape, at least a portion of the second radial surface remaining uncovered from the waist portion to face an interior of the garment;

the waist portion, the adhesive tape, and the elastic band collectively and resiliently stretchable to thereby bias the garment inward in the radial direction to retain the garment on the waist of the wearer, the elastic band including a first elastic strip and a second elastic strip, the first and second elastic strips each extending in the circumferential direction, the first and second elastic strips being joined by a plurality of connecting members that extend in the transverse direction, a tunnel collectively defined by the first and second elastic strips and the plurality of connecting members; and wherein the waistband assembly further comprises a resiliently elastic drawstring that is received within the tunnel.

* * * * *